United States Patent [19]

Berggren et al.

[11] Patent Number: 4,939,330

[45] Date of Patent: Jul. 3, 1990

[54] METHOD AND ARRANGEMENT FOR CONTROLLING OUTPUT POWER OF A PLURALITY OF MAGNETRONS CONNECTED TO A COMMON POWER SOURCE

[75] Inventors: Benny Berggren, Vällingby; Larsgöran Gustafsson, Uttran, both of Sweden

[73] Assignee: Alfastar AB, Tumba, Sweden

[21] Appl. No.: 159,594

[22] PCT Filed: Jun. 25, 1987

[86] PCT No.: PCT/SE87/00301

§ 371 Date: Mar. 1, 1988

§ 102(e) Date: Mar. 1, 1988

[87] PCT Pub. No.: WO88/00425

PCT Pub. Date: Jan. 14, 1988

[30] Foreign Application Priority Data

Jul. 4, 1986 [SE] Sweden ..... 8602990

[51] Int. Cl.[5] ..... H05B 6/68

[52] U.S. Cl. ..... 219/10.55 B; 219/10.55 M; 219/10.55 R; 315/107; 328/267; 323/282

[58] Field of Search ..... 219/10.55 B, 10.55 M, 219/10.55 R, 10.55 F; 315/107, 95; 331/86, 87, 186; 328/258, 267; 323/234, 282

[56] References Cited

U.S. PATENT DOCUMENTS

| | | | |
|---|---|---|---|
| 3,611,017 | 10/1971 | Freeland | 315/107 |
| 3,619,536 | 11/1971 | Boehm | 219/10.55 F |
| 3,735,237 | 5/1973 | Derby | 219/10.55 B |
| 3,780,252 | 12/1973 | Crapuchettes | 219/10.55 B |
| 4,149,057 | 4/1979 | Fritts | 219/10.55 B |

FOREIGN PATENT DOCUMENTS 2155633 5/1973 Fed. Rep. of Germany .

*Primary Examiner*—Philip H. Leung

*Attorney, Agent, or Firm*—Nies, Kurz, Bergert & Tamburro

[57] ABSTRACT

A method for controlling magnetrons with regard to their microwave power in those cases where a multiple of magnetrons are present. The method includes connecting two or more magnetrons in parallel with a power unit operative in generating a high voltage for operating the magnetron is connected to respective magnetrons and includes a current measuring circuit by which the anode current passing through respective magnetrons is measured on the high-voltage side of the magnetrons. The current measuring circuit is galvanically separated from a control circuit, which is arranged to control the anode current of a respective magnetron in response to a signal received from the current measuring circuit. Also an arrangement for carrying out the method.

19 Claims, 2 Drawing Sheets

METHOD AND ARRANGEMENT FOR CONTROLLING OUTPUT POWER OF A PLURALITY OF MAGNETRONS CONNECTED TO A COMMON POWER SOURCE

The present invention relates to a method and to an arrangement for controlling magnetrons in apparatus in which microwave energy is utilized for heating purposes.

Microwave heating is a technique which can be applied with great advantage in a multiple of processes which include the supply of thermal energy. One important advantage in this regard is that the heating power can be controlled in the absence of any inertia.

One drawback, however, is that microwave equipment is often more expensive than the conventional alternatives. The magnetron of such heating equipment is driven by a power unit with associated control system, which constitute the major cost of the equipment. Since the output power of a magnetron is limited, heating equipment will often require the presence of a significant number of magnetrons and associated power units and control systems to achieve a given heating requirement.

Magnetrons are used almost exclusively as microwave generators for heating purposes. Those properties decisive in this regard are the high efficiency achieved in converting d.c. power to microwave power and the compact geometry of the magnetron. One serious drawback is that the voltage required to produce a given power output varies from magnetron to magnetron. This voltage is determined by the internal geometry of the magnetron and the magnetic field strength in the cavity.

Two types of magnetrons are found, namely those in which the magnetic field is generated by a permanent magnet and those in which the magnetic field is generated by an electromagnet.

The strength of the permanent magnets varies in manufacture and during operation.

The magnetron construction includes a magnetic yoke, the permeability of which varies with temperature. The operating curve, seen as a graph in which the anode voltage is plotted against the anode current, changes together with the geometric changes that take place in the magnetron in response to changes in temperature therein. The output power is proportional to the anode current, to a high level of accuracy.

Because of these circumstances, it is not possible to drive a multiple of magnetrons directly from a common power unit. The aforementioned graph presents a knee, the so-called knee voltage, over which the power output of the magnetron is greatly increased.

When two or more magnetrons are connected to a power unit in parallel and the magnetrons have mutually different operating curves, which is the normal case, one magnetron will produce a higher power output than the other. The magnetron with the higher output power will become hotter than the other, wherewith the operating curve falls and the power unit will produce a lower output voltage. This causes the power output of the magnetron producing the lower output to fall still further, etc., until only the one magnetron produces all power, due to the failure to reach the knee voltage of the other magnetron.

The fundamental problem resides in the necessity of controlling each magnetron individually, together with the attempt to decrease the number of power units and associated control systems.

This problem is resolved by means of the present invention which enables magnetrons equipped with permanent magnets and magnetrons equipped with electromagnets to be powered by one and the same power unit.

Thus, the present invention relates to a method for controlling magnetrons with regard to their microwave power, in equipment incorporating a multiple of magnetrons, characterized by connecting two or more magnetrons in parallel with a power unit operative in producing a high voltage for operation of the magnetrons; by connecting to respective magnetrons a separate magnetron regulating circuit which includes measuring means for measuring the anode current through respective magnetrons on the high-voltage side thereof; and galvanically isolating said measuring means from a control circuit, said control circuit being constructed to control the anode current of the magnetron concerned in response to a signal produced by said measuring means.

According to another aspect, the invention relates to an arrangement or system for controlling two or more magnetrons from one and the same power unit, this arrangement having the characteristic features set forth in the following claim 10.

The invention will now be described in more detail with reference to a number of exemplifying embodiments thereof illustrated in the accompanying drawings, in which FIG. 1 illustrates schematically a first embodiment of a circuit or coupling for two or more magnetrons connected to a common power unit and having individual regulating circuits;

Figure 6:
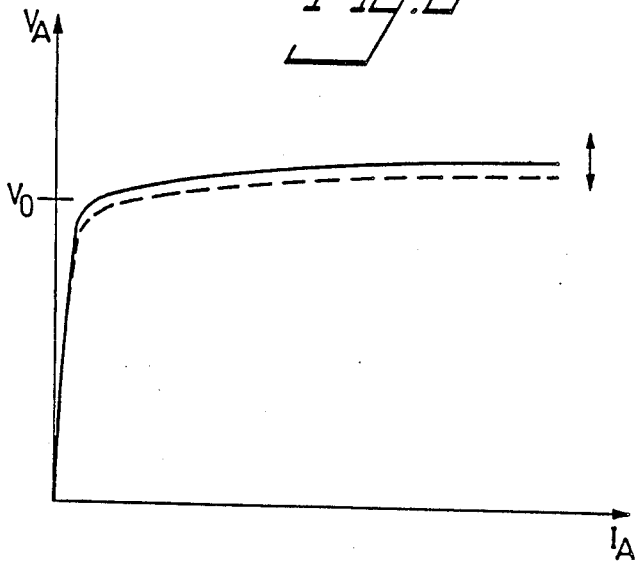
FIG. 6 illustrates a classic anode voltage - anode current ($V_A - I_A$) graph for a magnetron.

Thus, FIG. 6 illustrates an anode voltage - anode current graph which is typical of a magnetron. The curve in the graph presents a knee at voltage $V_0$. The magnetron will produce no power output at voltages beneath the knee voltage $V_0$. At voltages above the knee voltage, the dynamic resistance is low and the voltage increase from no output power to full output power is small. The power output of the magnetron is proportional to the anode current $I_A$ to a high level of accuracy.

As beforementioned, there are two types of magnetron, namely magnetrons in which a magnetic field is generated with the aid of permanent magnets, and magnetrons in which the magnetic field is generated by a magnetic coil and a magnetic core. The knee voltage is fixed in the former type of magnetron, whereas in the latter type the knee-voltage is controlled or regulated in the manner indicated by the broken-line curve and the arrow in FIG. 6, by controlling the current through the winding.

It has also been mentioned in the aforegoing that the graph $V_A - I_A$ is not totally the same for each magnetron of mutually the same specification, due to variations from magnetron to magnetron. Thus, this is the fundamental reason for the problem of powering two or more magnetrons from a common power unit.

The present invention relates to a method and to an arrangement or system for controlling a multiple of magnetrons with regard to their microwave power, in which two or more magnetrons are connected in parallel to a power unit effective in generating a high magnetron operating voltage. In accordance with the invention each magnetron is connected to a separate regulating circuit which is individual thereto. The regulating circuit includes a measuring means which is operative in measuring the anode current through the magnetron on the high-voltage side thereof. By measuring the anode current on the high-voltage side of the magnetron, the anode current will be measured individually for each of the magnetrons present while the anode of the magnetron is connected directly to earth, which is highly essential from the aspect of safety.

If the anode current were to be measured on the low-voltage side, i.e. at a location, e.g., between anode and earth, the magnetron would be raised at a given potential, which is unacceptable from a safety aspect, assuming that not all of the magnetron is encased in an earthed casing which is insulated from the magnetron, waveguide and possible heating cavity.

The measuring means is constructed to send a signal to a control circuit. Because the measuring means is located on the high voltage side, it is galvanically separated from the central circuit, which operates at a relatively low voltage such as normal mains voltage. The control circuit is intended to control the anode current of the magnetron, and therewith the power output, in response to the signal received from the measuring means.

According to one embodiment the measuring means comprises a resistance across which the voltage is measured, said voltage constituting the signal sent to the control circuit.

A more detailed description will now be given of magnetrons of the kind solely equipped with permanent magnets, with reference to the embodiments illustrated in FIGS. 1–4.

Figure 1:
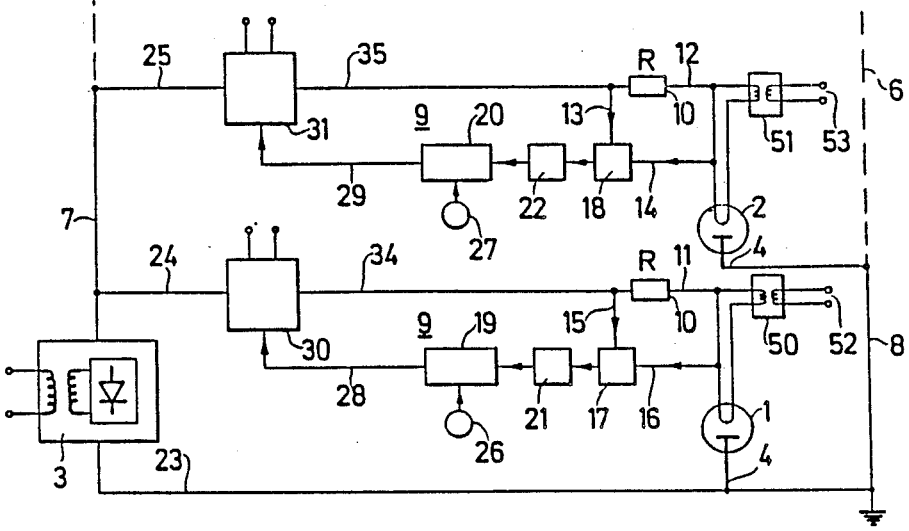

FIG. 1 is a schematic circuit diagram which incorporates two or more magnetrons 1, 2 of the aforesaid kind. These magnetrons are powered from a power unit 3 which is common to all magnetrons and which includes a transformer and a rectifier. The power unit 3 may have an output voltage of 3–4 KV for example.

In the FIG. 1 embodiment, two magnetrons 1, 2 are connected in parallel across the power unit 3. The anodes 4 of the magnetrons 1, 2 are earthed (grounded). As indicated in FIG. 1, several magnetrons can be connected to the broken-line conductors 5, 6 in the same manner as the two magnetrons 1, 2 and associated circuits connected to the conductors 7, 8.

A regulating circuit, generally referenced 9, separate for each magnetron is connected to respective magnetrons. The regulating circuit 9 incorporates the aforementioned measuring means 10 operative in measuring the anode current through respective conductors 11, 12. As beforementioned, the measuring means preferably comprises a resistance R across which the voltage is measured through conductors 13, 14; 15, 16. The conductors are connected to a measuring circuit 17; 18 of some suitable kind adapted to transfer the measuring value, in the form of said voltage, to a control circuit 19; 20, said value being transferred either in analogue or digital form.

The measuring means is galvanically separated from the control circuit 19, 20 by means of a circuit 21; 22. The circuit may take several different forms. However, a feature common to all forms of this circuit is that the circuit 21; 22 incorporates an analogue-digital converter or a digital-analogue converter, e.g. a frequency-voltage converter, in which the converters are isolated galvanically from one another.

Figure 7:
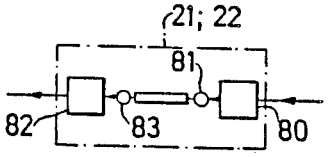
FIG. 7 illustrates schematically a circuit which separates two circuits electrically or galvanically.

The embodiment illustrated in FIG. 7 utilizes an optoswitch. In this case, the circuit 21; 22 includes a voltage-frequency converter 80 which drives a light-emitting device 81, such as a light-emitting diode, such that the light emitter sends light pulses at a pulse repetition frequency corresponding to the voltage applied to the converter 80. The circuit 21; 22 also incorporates a frequency-voltage converter 82 to which there is connected a light-sensitive device 83, such as a photo-transistor which receives light transmitted from the light-emitting device 81 and converts this light to electric pulses corresponding to the received light pulses. The converter 82 converts the pulses received, e.g., to a voltage that corresponds to the voltage applied across the first mentioned converter. The light is suitably passed between the devices 81, 83 in a light conductor 84, such as plastic or glass fibres.

According to a second embodiment the aforesaid means for converting a voltage to a frequency may instead be connected to the primary winding of a transformer, the secondary winding of which is connected to means for converting a frequency to a voltage, this latter voltage being delivered to the control circuit 19; 20.

The control circuit 19, 20 is intended for controlling the anode current of the magnetrons 1, 2 in response to a signal received from the measuring means 10. The control means 19, 20 preferably comprises a microprocessor or a corresponding device, into which a control value, or setpoint value, relating to the desired power output is inserted. The voltage across the conductors 23, 24; 23, 25 leading to respective power units may also be supplied to the control circuit. The control circuit is therewith constructed to calculate the product of this latter voltage and the anode current, this product constituting a relatively acurate measurement of the power output from respective magnetrons. The magnetrons have an efficiency of about 70%.

As will be understood, the anode voltage - anode current diagram of the magnetrons may instead be inserted in the control circuit, so that the circuit is able to calculate the prevailing output powers. The control circuit 19, 20 may be of any suitable kind and may have any desired, suitable construction.

The aforementioned control value is given in the form of an electric signal. The signal preferably constitutes a measurement of the desired anode current. The signal, however, may instead have the form of an output signal from a temperature sensor in the volume or the area in which the magnetron concerned delivers its power, wherewith a temperature control is effected actually by means of the output power. The reference 26; 27 designates the setting means intended for sending a control value to the control circuit. As will be understood, this means may comprise an overall control system in the form of a computer or like device to which the control circuits of all magnetrons are connected.

Thus, the control circuit receives a control value from the means 26; 27 and a real value, or true value, from the measuring circuit 17; 18. The control circuit 19; 20 is constructed to deliver, via conductors 28; 29, a control signal to a regulating circuit that contains control devices 30; 31 for direct control of the anode current.

The control device may have several different, preferred forms.

Figure 2:
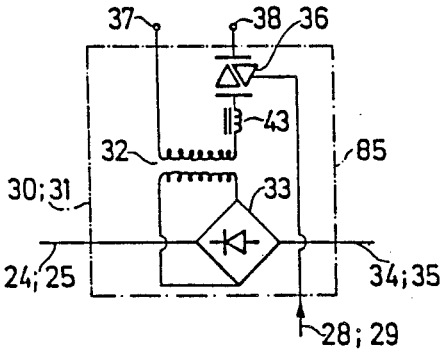
FIG. 2 illustrates a first embodiment of control means associated with said regulating circuit.

According to one first preferred embodiment, illustrated in FIG. 2, the control device 30; 31 comprises a peak voltage unit 85.

This unit is connected between the power unit 3 and the measuring means 10, and is constructed to apply a further voltage across the magnetrons 1, 2 e.g. a voltage of 200–800 V, over and above the voltage delivered by the power unit.

The peak voltage unit includes a transformer 32 having a rectifying bridge 33, the one diagonal points of which are connected to the conductors referenced 24, 34; 25, 35 in FIGS. 1 and 2. The other diagonal points of the rectifying bridge 33 are connected to the secondary winding of the transformer 32. The primary winding of the transformer is connected to thyristors 36, a triac or like device, by means of which a phase-angle control is intended to be effected on the power supplied to the peak voltage unit via its terminals 37, 38. The peak voltage unit may be supplied with an alternating current of, e.g., 380 V.

The semiconductor element 36 may be a so-called SCR circuit (Silicon Control Rectifier).

The thyristor 36 is controlled directly from the control circuit 19; 20, through a control conductor referenced 28; 29.

A choke 43 or leakage transformer may be connected in series with the thyristor 36.

Figure 3:
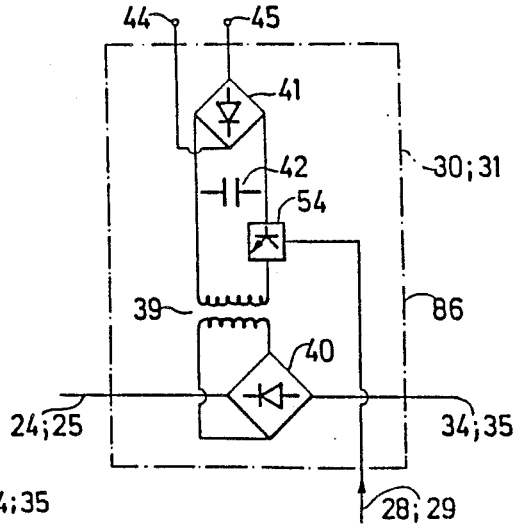
FIG. 3 illustrates a second embodiment of control means associated with said regulating circuit.

According to a second preferred embodiment illustrated in FIG. 3, in which the same designations have been used as those used in FIGS. 1 and 2, there is also used a peak voltage unit 86, which includes a transformer 39 and a first rectifying bridge 40 connected to the secondary winding of the transformer 39. A chopper 54 or the like is connected in parallel across a second rectifying bridge 41, this chopper 54 being intended for supplying the primary winding of the transformer with a high frequency, e.g. 20 kHz. The chopper 54 is thus intended to enable a so-called primary-switched control to be made. A capacitor 42 is connected in parallel across the second rectifying bridge 41.

An alternating current, e.g. having a voltage of 380 V, is applied to the second rectifying bridge, via the terminals 44, 45. The chopper is controlled directly by means of the control conductor 28; 29 from the control circuit 19; 20. The output voltage from the first rectifying bridge 40 may, for example, be 200–800 V.

By generating a high frequency, via a d.c. voltage intermediary in accordance with this embodiment, a high voltage can be generated with a smaller transformer core 39 than that used in the embodiment illustrated in FIG. 2.

Figure 4:
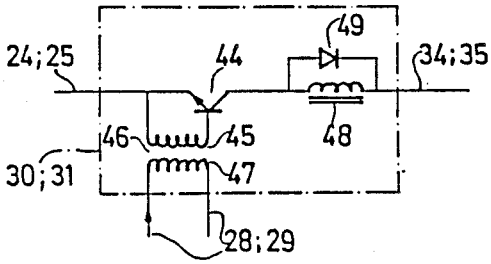
FIG. 4 illustrates a third embodiment of control means associated with said regulating circuit.

According to a third preferred embodiment illustrated in FIG. 4, the power unit 3 is intended to deliver a voltage which is higher than the highest voltage required by the magentrons 1, 2, the peak voltage unit in this case being constructed to reduce the voltage across the magnetrons.

A transistor switch 44, or like device, is connected between the power unit and each of the aforesaid measuring means 10, each of which transistor switches is constructed in a manner which enables the switches to be controlled so as to limit the anode current through respective magnetrons, as compared with the case with the anode current which would occur if the peak voltage unit were to be controlled in a manner not to reduce the voltage of the power unit. The transistor switch 44 is controlled with a control current through a secondary winding 45 by a transformer 46, the primary winding 47 of which is supplied with current from the control circuit 19; 20, through the control conductor 28; 29. The purpose of the transformer 46 is to separate the transistor switch 44 on the high-voltage side from the regulating circuit 9, which operates at low voltage.

A choke 48 and a diode 49 connected in parallel over the choke are provided for restricting the increase in anode current with time.

Thus, a common feature of the embodiments described with reference to FIGS. 1–4 is that a common power unit can be used for powering two or more magnetrons having permanent magnets, merely by connecting an inexpensive and simple peak voltage unit to each of the magnetrons. The peak voltage unit enables each of the magnetrons to be controlled to a desired power output irrespective of the prevailing output of the remaining magnetrons.

A filament transformer 50; 51 is also connected to each magnetron in a conventional manner, the transformers being supplied from a voltage source 52; 53.

When the magnetrons are of the kind in which the magnetic field is generated by means of a magnetic winding or coil, there is provided for each magnetron a separate magnetizing unit which is connected to said winding and which is controlled by the control circuit in a manner such that the strength of the magnetic field in the magnetron at the prevailing voltage over said magnetron provides a pre-determined anode current through said magnetron.

Figure 5:
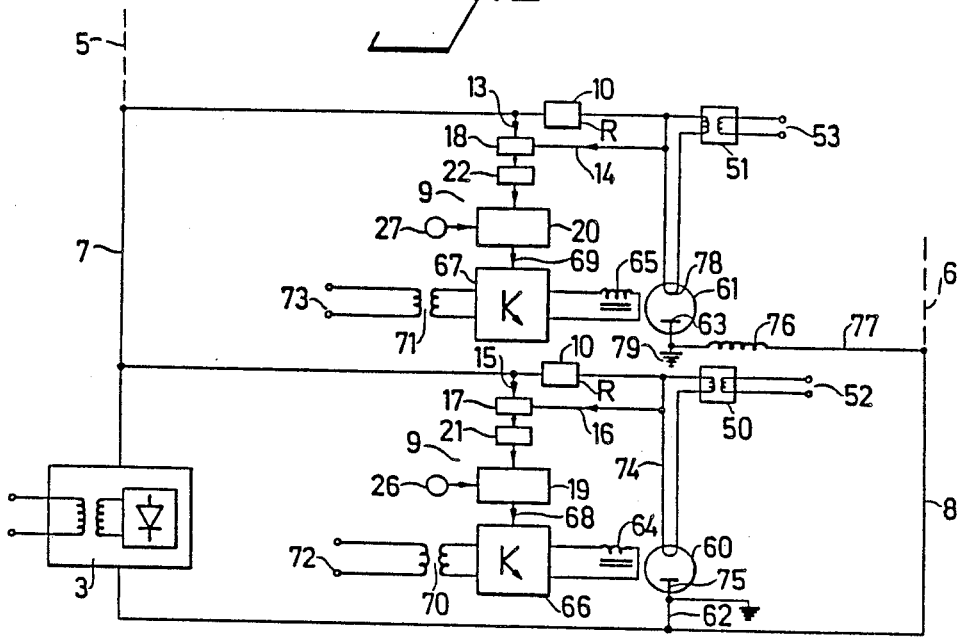
FIG. 5 illustrates a second embodiment of an inventive circuit or coupling for two or more magnetrons connected to a common power unit and having individual regulating circuits.

One such arrangement is illustrated by way of example in FIG. 5. Those elements in FIG. 5 which correspond to similar elements in FIGS. 1–4 have been identified by the same reference numerals. Thus, the embodiment of FIG. 5 includes a power unit 3 and conductors 7, 8. The measuring means 10, the measuring circuit 17; 18, the circuit 21; 22 and the control circuit 19; 20 and the means 26; 17 may be arranged in the same manner as that described above.

The magnetrons 60, 61 have an earthed anode 62, 63. The magnetrons 60, 61 are thus provided with a magnetic winding 64, 65 having an associated magnetic core for generating a magnetic field in the magnetrons. Such magnetrons may also be provided with a permanent magnet, although this magnet will not be capable by itself of generating a magnetic field sufficiently strong to generate microwaves.

A separate magnetizing unit 66; 67 is provided for each magnetron, for magnetizing purposes, said units being a current supply unit for supplying current to the magnetic windings 64; 65. As mentioned in the introduction, the anode voltage - anode current curve is moved up and down in accordance with the strength of the magnetic field. Thus, in this embodiment the voltage across the magnetron is substantially constant whereas the power output is controlled by lowering or raising the curve. This is effected by regulating the current through the magnetic windings.

As with the aforedescribed embodiments, the control circuit 19; 20 is supplied with a control value or set point value, and a real value. The control circuit 19, 20 of this embodiment is intended to deliver to the magnetizing unit 66; 67 a control signal over a conductor 68; 69, thereby to control the magnetizing unit in a manner such that the magnetic field strength of the magnetron at the prevailing voltage across the magnetron will provide a pre-determined anode current through said magnetron.

The magnetizing unit 66, 67 includes a rectifier and a current control device, such as a transistor or the like. The transistor or the like is controlled by means of said control signal.

Any suitable circuit can be used. The magnetizing unit 66; 67 is supplied via a transformer 70; 71 from a voltage source 72; 73 with an alternating current which may, e.g., have a voltage of 380 V.

In the lower part of FIG. 5 there is illustrated an embodiment in which the magnetic winding 64 is separated from the conductor 74 connected to the anode 75 of the magnetron 60.

According to another embodiment, illustrated in the upper part of FIG. 5, a part 76 of the magnetic winding is connected in series to the conductor 77 which is connected to the anode 63 of the magnetron 61. Located between the winding 76 and the anode 63 of the magnetron is an earthing point 79, implying that the anode 63 is at earth potential.

It is suitable, however, for the same type of magnetron winding and control circuit to be used in all magnetrons supplied by the same power unit, even though two variants have been shown in FIG. 5.

It will be obvious that further magnetrons with associated control circuits can be connected in parallel across the power unit, via the broken-line conductors 5, 6 in FIG. 5.

It will also be understood that the power output of respective magnetrons can be controlled individually and irrespectively of the prevailing power output of remaining magnetrons, by means of the respective control circuits and respective magnetizing units.

Thus, the present invention solves the problem mentioned in the introduction, by using a common power unit for two or more magnetrons, at the same time as the anode current for each magnetron is measured on the high-voltage side and used to control each magnetron separately. The cost represented by the individual control circuits is only a fraction of the cost of a power unit.

The present invention can be applied to particular advantage in heating systems which incorporate a large number of magnetrons. In addition to requiring solely one power unit, the invention affords the added advantages that the weight of the system and the material required for its installation is less than that of conventional systems, at the same time as the volumetric bulk of the inventive system is much lower due to the fact that a multiple of power units is not required. The amount of wiring required is also greatly reduced.

Another advantage afforded by the invention is that in the case of a large system, the power unit can be dimensioned to power all magnetrons i.e. a greater number of magnetrons than, e.g., two to four magnetrons. In this case, not all magnetrons are activated in normal operation. When a magnetron needs to be changed, however, the magnetron is switched off and another, not previously activated magnetron, is activated so as to produce microwave power.

Another advantage afforded by the present invention is that the individual control, in which the anode current is measured, enables the magnetron to be controlled in a manner to compensate, e.g., for changes due to age.

A number of exemplifying embodiments of the invention have been described above. It will be understood that the circuits and components described by way of example can be replaced and modified by one skilled in this art and achieve the same function without departing from the basic concept of indivually controlling each magnetron by measuring the anode current on the high-voltage side.

The present invention shall not therefore be considered limited to the aforedescribed embodiments, since modifications can be made within the scope of the following claims.

We claim:

1. A method for controlling magnetrons with regard to their microwave power in systems which incorporate a plurality of magnetrons, wherein two or more of said magnetrons (1, 2; 60, 61) are connected in parallel with a common power unit (3) which provides high-voltage for operating said magnetrons; said method comprising: the step of providing a separate regulating circuit (9) connected to and individual to a respective associated magnetron (1, 2; 60, 61), each said regulating circuit (9) including a control circuit and measuring means (10) by means of which the anode current passing through a respective associated magnetron is measured on the high-voltage side of said magnetron; the step of electrically separating each said measuring means (10) from its associated control circuit (19; 20); and providing that each said control circuit will control the anode current of its associated said magnetron in response to a signal received from the associated said measuring means (10).

2. A method according to claim 1, wherein permanent magnets are used with said magnetrons and the magnetic field of each of said magnetrons is generated solely by said permanent magnets, the further steps of applying to each magnetron a further voltage, in addition to the voltage delivered by said common power unit (3), with the aid of an individual peak voltage unit (85; 86) separate for each magnetron (1, 2) and connected between the common power unit (3) and an associated said measuring means (10) for the associated magnetron.

3. A method according to claim 2, characterized in that the peak voltage unit (85) includes a transformer (32) having a rectifying bridge (33) which is controlled by means of phase angle control, where a thyristor pair (36), connected to the primary winding of the transformer (32) is controlled.

4. A method according to claim 2, characterized in that the peak voltage unit (86) includes a transformer (39) having a first rectifying bridge (40) which is controlled by means of a primary switch control, where the primary winding of the transformer (39) is supplied with a high frequency generated by means of a chopper (54) connected in parallel across a second rectifying bridge (41), said chopper (54) being controlled.

5. A method according to claim 1, wherein permanent magnets are used with said magnetrons and the magnetic field of each of the magnetrons is generated solely by said permanent magnets, the further steps of causing the common power unit (3) to deliver a voltage which is higher than the maximum required voltage of the magnetrons (1, 2); and by controlling each individual magnetron by means of an associated individual current switch control, wherein a solid states switch (44) is connected between the common power unit (3) and each of said measuring means (10), each said solid states switch (44) being controlled in a manner to restrict the anode current through its associated magnetron (1, 2).

6. A method according to claim 1, wherein electromagnets, each with a magnetic winding, are used with said magnetrons and the magnetic field of each of the magnetrons is generated by an associated said electromagnet and its winding; characterized by connecting to the electromagnet winding (64; 65) associated with each magnetron (60; 61), a separate, individual magnetizing unit (66; 67); controlling said each said magnetizing unit by an associated said control circuit (19; 20) in a manner such that the magnetic field strength in respective magnetrons (60; 61) at prevailing voltage over the magnetrons provides a pre-determined anode current through the magnetrons.

7. A method according to claim 6, characterized by passing the anode current through a conductor (74) which is separate from the associated said magnetic winding (64).

8. A method according to claim 6, characterized by passing the anode current through a part (76) of the associated magnetizing winding of the magnetron (61).

9. A method according to claim 1, characterized in that the measuring means (10) comprises a resistance (R) across which the voltage is measured.

10. An arrangement for individually controlling magnetrons with regard to their microwave power in a system in which a plurality of magnetrons are present, wherein the arrangement includes a common power unit (3) operative to generate a high voltage for operating the plurality of magnetrons (1, 2; 60, 61) and to which said magnetrons (1, 2; 60, 61) are connected in parallel; for each magnetron (1, 2; 60, 61), and connected thereto, is a separate, individual regulating circuit (9) which includes measuring means (10) connected to the high voltage side of its associated said magnetron to measure the anode current through the associated said magnetron (1, 2; 60, 61) on the high-voltage side of said associated magnetron; wherein each regulating circuit includes a control circuit; means are provided for each regulating circuit for electrically isolating said measuring means (10) from its associated said control circuit (19; 20); and said control circuit (19; 20) being arranged and connected to control the anode current of the associated magnetron in response to a signal received from the associated said measuring means (10).

11. An arrangement according to claim 10, wherein permanent magnets are provided for each of said magnetrons and the magnetic field of each of said magnetrons is generated solely by the associated said permanent magnets, a separate, individual peak voltage unit (85; 86) is provided for each one of said magnetrons and is connected to its associated said magnetron, being connected between said common power unit (3) and an associated one of said measuring means (10); and each said peak voltage unit (85; 86) is enabled to apply a further voltage across its associated said magnetron (1, 2) in addition to the voltage supplied by the power unit.

12. An arrangement according to claim 11, wherein each said peak voltage unit (85) includes a transformer (32) with primary and secondary windings and having a rectifying bridge (33), and the primary winding of said transformer (32) is connected to a thyristor pair (36), by means of which phase-angle control is effected.

13. An arrangement according to claim 11, wherein each said peak voltage unit (86) includes; a transformer (39) with primary and secondary windings and having a first rectifying bridge (40); a second rectifying bridge and a chopper (54) connected in parallel across said second rectifying bridge (41); said chopper being provided and connected to supply the primary winding of said transformer (39) with a high frequency and being operative in effecting a primary switched control.

14. An arrangement according to claim 10, wherein permanent magnets are individually provided for each of said magnetrons and the magnetic field of each of said magnetrons is generated solely by an associated said permanent magnet, said common power unit (3) is enabled to deliver a voltage which is higher than the highest required voltage of said magnetrons (1, 2); a transistor switch (44) for each magnetron is associated with and is connected between the common power unit (3) and each of the associated said measuring means (10), each of said transistor switches (44) being controllable in a manner to limit the anode current through its associated magnetron (1,2).

15. An arrangement according to claim 10, wherein electromagnets with windings are individually provided for each of said magnetrons and the magnetic field (60,61) of the magnetrons is generated by an associated electromagnet; a magnetizing unit (66; 67) is provided for and is independently connected to an associated electromagnet winding, separate and individual for each said magnetron (60; 61) and the associated control circuit (19; 20) for each magnetron is arranged to control the associated magnetizing unit (66; 67) in a manner so that the magnetic field strength of the magnetrons (60; 61) at prevailing voltage across the magnetrons provides a pre-determined anode current through the magnetrons (60; 61).

16. An arrangement according to claim 15, characterized in that each electromagnet winding (64) is isolated from a conductor (74) connected to the anode of the associated said magnetron (60).

17. An arrangement according to claim 15, characterized in that part (76) of each electromagnet winding is connected in series to a conductor (27) connected to the anode (63) of the associated said magnetron (61).

18. An arrangement according to claim 10, characterized in that each measuring means (10), comprises a resistance (R) across which the associated said magnetron voltage is intended to be measured.

19. An arrangement according to claim 10, wherein an independent electrical isolating circuit (21; 22) is provided between each measuring means (10) and its associated control circuit (19; 20), each said isolating circuit including a voltage-frequency converter(18) and a frequency-voltage converter (82), an electrically isolating means being provided for electrically separating said two converters (18; 82) from one another.

* * * * *

UNITED STATES PATENT AND TRADEMARK OFFICE

CERTIFICATE OF CORRECTION

PATENT NO. : 4,939,330

DATED : July 3, 1990

INVENTOR(S) : BENNY BERGGREN et.al.

It is certified that error appears in the above-identified patent and that said Letters Patent is hereby corrected as shown below:

On the cover page, in the ABSTRACT, line 6, between "magnetron" and "is", please insert --. A separate control circuit individual for each magnetron--.

Signed and Sealed this

Fourteenth Day of May, 1991

*Attest:*

HARRY F. MANBECK, JR.

*Attesting Officer*

*Commissioner of Patents and Trademarks*